US008413327B2

(12) United States Patent
Matsumoto et al.

(10) Patent No.: US 8,413,327 B2
(45) Date of Patent: Apr. 9, 2013

(54) METHOD OF MANUFACTURING PRINT HEAD AND PRINT HEAD

(75) Inventors: Tadashi Matsumoto, Tokyo (JP); Hitoshi Tsuboi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 708 days.

(21) Appl. No.: 12/484,396

(22) Filed: Jun. 15, 2009

(65) Prior Publication Data

US 2009/0315949 A1 Dec. 24, 2009

(30) Foreign Application Priority Data

Jun. 20, 2008 (JP) ..... 2008-161757

(51) Int. Cl.
*B41J 2/145* (2006.01)
*B41J 2/015* (2006.01)

(52) U.S. Cl.
USPC ..... 29/890.1; 29/592.1; 29/832; 438/21; 216/27

(58) Field of Classification Search ..... 29/890.1, 29/611, 852, 830, 831, 832, 847, 625, 622; 347/54, 50, 40, 68, 69, 70, 71, 72; 216/27, 216/97
See application file for complete search history.

(56) References Cited

U.S. PATENT DOCUMENTS 6,846,064 B2 * 1/2005 Yamane ..... 347/40
7,441,854 B2 10/2008 Jahana et al.
7,517,052 B2 4/2009 Wada et al.
7,618,119 B2 * 11/2009 Shibata et al. ..... 347/43
2005/0140722 A1 * 6/2005 Shibata et al. ..... 347/40

FOREIGN PATENT DOCUMENTS

JP 2005-144919 A 6/2005
JP 2005-199692 7/2005
JP 2005-199696 7/2005
JP 2006-264188 A 10/2006
JP 2006-341518 A 12/2006
JP 2007-1137 A 1/2007
JP 2007-29786 A 2/2007

OTHER PUBLICATIONS

Notification of Reasons for Refusal issued Sep. 25, 2012, in Japanese Application No. 2008-161757.

* cited by examiner

*Primary Examiner* — Derris Banks
*Assistant Examiner* — Kaying Kue
(74) *Attorney, Agent, or Firm* — Fitzpatrick, Cella, Harper & Scinto

(57) ABSTRACT

A checker array print head is able to output an image with possible white or black stripes made unnoticeable even when the conveyance direction of a print medium with respect to the ink jet print head is skewed. A first chip located on an upstream side in a conveyance direction (X direction) and a second chip located on a downstream side in the conveyance direction are arranged such that a dot printed via the first chip and a dot printed via the second chip are printed at intervals shorter than a print resolution in an ejection port arrangement direction (Y direction). Thus, even if the conveyance direction of the print medium is skewed by meandering thereof or the like, possible white stripes, which are particularly noticeable, can be inhibited.

3 Claims, 9 Drawing Sheets

METHOD OF MANUFACTURING PRINT HEAD AND PRINT HEAD

BACKGROUND OF THE INVENTION

1. Field of the Invention

The present invention relates to an ink jet print head including integrally arranged ejection ports from which ink is ejected, and a method of manufacturing the ink jet print head. More specifically, the present invention relates to the configuration of an ink jet print head which, when an elongate ink jet print head is used for printing, makes possible white or black stripes as unnoticeable as possible, the stripes being generated by fluctuation or meandering of the relative movement between the ink jet print head and a print medium.

2. Description of the Related Art

With the spread of copying apparatuses, information processing apparatuses such as word processors and computers, communication equipment, and the like, ink jet printing apparatuses printing digital images based on an ink jet scheme have been prevailing as output apparatuses printing images for the above-described apparatuses. The ink jet printing apparatus uses an ink jet print head with a plurality of integrally arranged ejection ports for printing. Techniques for such integral arrangement have been significantly improved in response to recent demands for higher resolution and high-speed output. Many full-line type ink jet printing apparatuses have also been provided which use an ink jet print head including a large number of densely arranged ejection ports corresponding to the width of print medium.

In a full-line type ink jet printing apparatus using an elongate ink jet print head, the elongate ink jet print head is fixed to the printing apparatus and ejects ink from individual ejection ports at a constant frequency as droplets. At the same time, a print medium is conveyed in a direction crossing the array direction of the ejection ports, at a constant speed corresponding to the ejection frequency and print resolution. That is, the operation of conveying only printing medium allows high-resolution images to be output at high speed.

For such an elongate ink jet print head, a method has been proposed which first manufactures a chip with a smaller number of ejection ports and combining a plurality of the chips together, in order to increase manufacturing yield.

FIG. 2 is a diagram showing arrays of ejection ports in an elongate ink jet print head disclosed in Japanese Patent Laid-Open No. 2005-199696. In FIG. 2, reference numerals 81 to 86 each denote a chip with two ejection port arrays. In the elongate ink jet print head 7, the chips 81 to 86 are consecutively arranged in the Y direction so as to be alternately staggered with respect to each other in the X direction.

The chips 81 to 86 have the same configuration and eject the same type of ink. For example, the chip 81 has an ejection port array 81A with ejection ports arrayed at a pitch of 600 dpi in the Y direction and an ejection port array 81B with ejection ports arrayed also at a pitch of 600 dpi in the Y direction. The two ejection port arrays are staggered with respect to each other by a half pitch (corresponding to 1,200 dpi). Thus, on a print medium conveyed in an X direction, dots can be printed at a resolution of 1,200 dpi. Such an elongate ink jet print head manufactured such that chips of the same type are staggered with respect to one another is hereinafter referred to as a "checker array print head".

On the other hand, Japanese Patent Laid-Open No. 2005-199692 discloses a checker array print head with a plurality of chips arranged so as to form an overlap area in which the individual chips overlap one another in the Y direction.

FIG. 3 is a diagram showing arrays of ejection ports in two chips 90 and 91 in the checker array print head disclosed in Japanese Patent Laid-Open No. 2005-199692. According to Japanese Patent Laid-Open No. 2005-199692, in the overlap area in which the two chips 90 and 91 overlap, four ejection ports in each of the two chips are arranged at the same position in the Y direction. Japanese Patent Laid-Open No. 2005-199692 discloses a printing method in which the four ejection ports on each of the two chips alternately print one pixel line on a print medium conveyed in the X direction.

Specifically, print data arrayed in one line in the X direction is sorted into a plurality of ejection port arrays using a prepared mask pattern. In this case, for areas in which the two chips do not overlap, the print data is sorted into two arrays 94A and 94B or 94C and 94D. For the overlap area, the data is sorted into the four arrays 94A, 94B and 94C, 94D. The distribution rate for the sorting of the print data may be uniform or may vary among the ejection port arrays. Furthermore, for the overlap area, a mask pattern may be used which is made such that the distribution rate increases gradually from the ejection port at the end of the chip toward the center of the chip.

In the process of manufacturing a checker array print head, the arrangement of the individual chips inevitably involves a certain error. Black or white stripes may be observed in an image area printed via a boundary portion of each chip. However, in this case, such an overlap area as shown in the figure allows pixel lines arranged in the X direction and printed via the overlap area to be formed by four types of dots ejected from the two chips. That is, even if the two chips are slightly misaligned, an affect of the misalignment is prevented from concentrating at one position. Thus, a smooth boundary area with the possible black or white stripes made unnoticeable can be output. A method has also been proposed in which the amount of ink droplets ejected from ejection ports used to print the boundary portion is different from that of ink droplets ejected from the other ejection ports, in order to inhibit the image at the boundary portion from being degraded.

The checker array print head having two ejection port arrays in each chip has been described taking Japanese Patent Laid-Open Nos. 2005-199696 and 2005-199692 by way of example. However, the checker array print head need not necessarily include a plurality of ejection port arrays in each chip. The present specification considers any ink jet print head to be of the checker array type provided that a plurality of chips each with at least one ejection port array are consecutively arranged in the Y direction so as to be alternately staggered with respect to each other in the X direction. Any checker array print head configured as described above can exert such effects as disclosed in Japanese Patent Laid-Open No. 2005-199692.

However, in an ink jet printing apparatus using the checker array print head, negative effects on images associated with the accuracy with which the print medium is conveyed with respect to the ink jet print head have been acknowledged as problems. In particular, if a full-line type checker array print head in which individual ejection ports are densely arranged is used to print images on roll paper or the like at a high resolution of at least 1,200 dpi, possible meandering of the print medium has been determined to seriously affect output images. The negative effects on images caused by such meandering will be described below in detail.

FIG. 4 is a schematic diagram of a print head illustrating the negative effects associated with the meandering of the print medium. In FIG. 4, reference numerals 101, 102, and 103 denote three consecutive chips arranged in a checker array print head 100 and including ejection ports arrayed at a pitch of 1,200 dpi (a distance of 21 μm) The chips 101, 102, and 103 have an overlap area corresponding to four pixels. When the print medium is conveyed in a direction (X direction) perpendicular to an ejection port array direction (Y direction), dots printed via the first chip 101 and dots printed via the second chip 102 are regularly arranged at a pitch of 21 μm in the Y direction.

FIGS. 5A and 5B show print conditions and dot density distributions observed when the checker array print head shown in FIG. 4 is used. In FIG. 5A, one dot of diameter 35 μm is printed. In FIG. 5B, three dots are consecutively printed in the Y direction at a print resolution of 1,200 dpi. The single dot results in a density distribution with a peak located at the center of the dot as shown in FIG. 5A. When the plurality of dots are regularly arranged at intervals of 21 μm as shown in FIG. 5B, the density distribution includes a region with an almost uniform density value appearing consecutively in the Y direction.

Like FIGS. 5A and 5B, FIGS. 6A to 6E show dot print conditions and dot density distributions observed when the ink jet print head 100 is used. Each of FIGS. 6A to 6E shows the case in which the print medium is conveyed in a regular direction shown by a dash line in FIG. 4 and the case in which the print medium is skewed during the conveyance as shown by a solid arrow in FIG. 4. For description, the dots printed via the ejection ports in the chip 101 are shown by a pattern different from that for the dots printed via the ejection ports in the chip 102.

FIG. 6C is a diagram showing that the print medium is conveyed in the regular direction shown by the dash line in FIG. 4. The dot groups printed via the chips 101 and 102, respectively, are regularly arranged at intervals of 21 μm in the Y direction, similarly to the dots printed via the ejection ports in the same chip. Thus, the density distribution shows that an area is formed in which an almost uniform density value appears consecutively as in the case of FIG. 5B.

Now, with reference to FIG. 4, the case will be discussed in which the print medium is conveyed in a direction (−θ direction) angled with respect to the X direction. In this case, compared to the dots printed via the first chip 101, the dots printed via the second chip 102 are arranged at intervals larger than those (21 μm) corresponding to the print resolution. The intervals increase consistently with the skew of the print medium during the conveyance. That is, the dot print conditions and density distributions are as shown in FIGS. 6D and 6E. The density distributions show that an area with a lower density appears between the dot groups printed via the first and second chips 101 and 102, respectively.

On the other hand, when the print medium is conveyed in a +θ direction, the dots printed via the first and second chips 101 and 102 are arranged at intervals smaller than those (21 μm) corresponding to the print resolution. The intervals decrease with increasing skew of the print medium during the conveyance. That is, the dot print condition and density distribution are as shown in FIGS. 6A and 6B. The density distributions show that an area with a higher density appears between the dot groups printed via the first and second chips 101 and 102, respectively.

In contrast, the relationship between the chips 102 and 103 is reverse to that between the chips 101 and 102, described above. That is, an area with a higher density appears when the conveyance direction is skewed toward the −θ direction. An area with a lower density appears when the conveyance direction is skewed toward the +θ direction. As a result, if the conveyance direction of the print medium deviates from the regular direction, then in an output image, an area with a lower density and an area with a higher density appear alternately at a link of each chip. If the density value of the area with the higher density is larger than that of the other areas by at least a predetermined value, the area is viewed as black stripes. If the density value of the area with the lower density is smaller than that of the other areas by at least a predetermined value, the area is viewed as white stripes.

The negative effects of the skew of the print medium during the conveyance described above relate significantly to the difference between the two chips in the X direction. That is, as shown in FIG. 4, the amount of misalignment between the chips 101 and 102 (the distance, in the Y direction, between two dots printed via each of the chips 101 and 102) increases consistently with the distance L between the chips 101 and 102 in the X direction. Thus, if chips with more ejection port arrays in the X direction are prepared in order to achieve a higher print resolution, the distance between the ejection port arrays on the adjacent chips positioned on the opposite sides in the X direction may increase to further increase the amount of misalignment between printed dots.

The negative effects associated with the skew of the conveyance direction which is described above have not been successfully eliminated by the method disclosed in Japanese Patent Laid-Open No. 2005-199692. If an image is printed in an overlap area via different ejection ports in the respective chips as described in Japanese Patent Laid-Open No. 2005-199692, local white or black stripes are unlikely to appear. However, the density of the entire overlap area is lower than that of the other areas, resulting in a noticeable band-like unevenness.

SUMMARY OF THE INVENTION

The present invention has been made to solve the above-described problems. Thus, an object of the present invention is to provide a checker array print head configured to be able to output an image with possible white or black stripes made unnoticeable even when the conveyance direction of a print medium with respect to the ink jet print head is skewed.

The first aspect of the present invention is a method of manufacturing an ink jet print head comprising a first chip and a second chip each including a plurality of ejection ports from which ink is ejected to a print medium moving in a first direction, the ejection ports being arrayed at a predetermined interval in a second direction crossing the first direction, the first and second chips being arranged on a upstream side and on a downstream side, respectively, in the first direction so that the plurality of ejection ports in the first and second chips are consecutively arrayed in the second direction, the method comprising: a step of acquiring range of variation in the movement direction of the print medium with respect to the first direction; a setting step of setting a distance between an ejection port in the first chip and an ejection port in the second chip based on the variation range, the ejection ports in the first and second chips being used to print pixels adjacent to each other in the second direction; and an arranging step of arranging the first and second chips according to the distance.

The second aspect of the present invention is an ink jet print head comprising a first chip and a second chip each including a plurality of ejection ports from which ink is ejected to a print medium moving in a first direction, the ejection ports being arrayed at a predetermined interval in a second direction crossing the first direction, the first and second chips being arranged on a upstream side and on a downstream side, respectively, in the first direction so that the plurality of ejection ports in the first and second chips are consecutively arrayed in the second direction, wherein a distance, in the second direction, between an ejection port in the first chip and an ejection port in the second chip, that are used to print pixels adjacent to each other in the second direction, is set to be smaller than the predetermined interval and larger than 0.

The above and other objects, effects, features and advantages of the present invention will become more apparent from the following description of embodiments thereof taken in conjunction with the accompanying drawings.

Further features of the present invention will become apparent from the following description of exemplary embodiments (with reference to the attached drawings).

DESCRIPTION OF THE EMBODIMENTS

An embodiment of the present invention will be described below in detail.

Figure 1A:
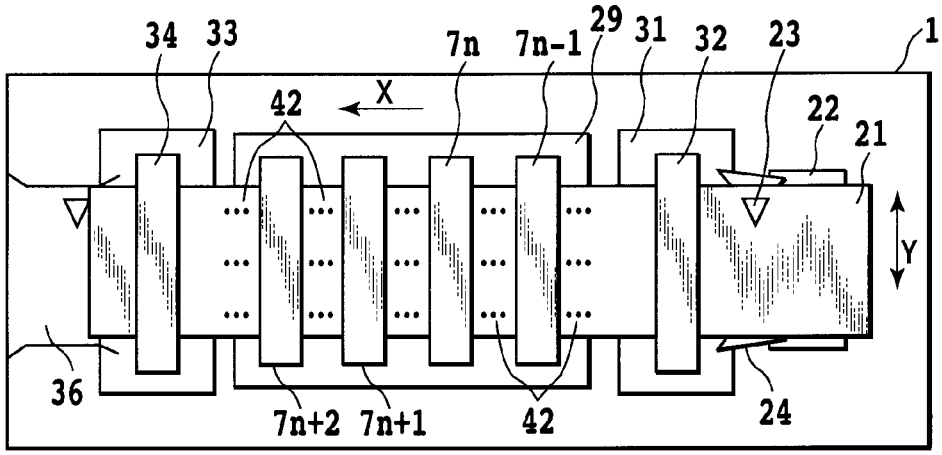
FIGS. 1A and 1B are a top view and a sectional view, respectively, illustrating the general configuration of a full-line type ink jet printing apparatus adopted for an embodiment of the present invention.
Figure 1B:
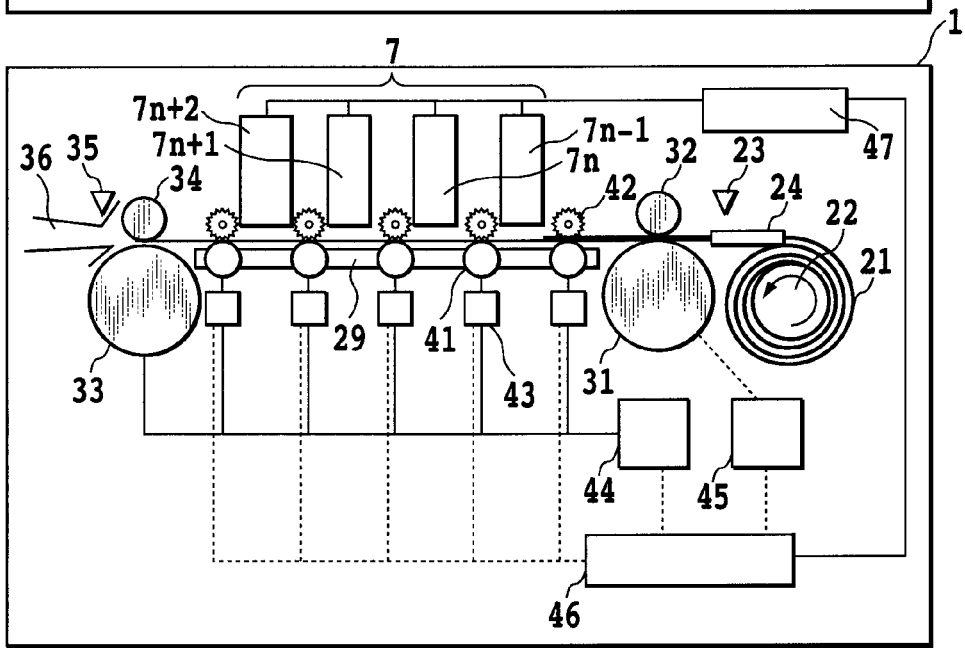

FIGS. 1A and 1B are a top view and a sectional view, respectively, illustrating the general configuration of a full-line type ink jet printing apparatus adopted for the embodiment of the present invention. In an apparatus main body 1, a print medium (roll paper) 21 is wound around a roll rotating member 22 and held in roll form. The roll paper 21 is a paper dedicated for ink jet printing. The roll paper 21 is wound so that its coat layer provided for improving ink absorption is located on the outside.

When a command for a printing operation is input to the printing apparatus, the roll rotating member 22 rotates in the direction of an arrow in the figures. The roll paper 21 (print medium) is thus separated from the roll rotating member 22. Then, the movement direction of the roll paper 21 is regulated by a regulating plate 24. A leading end of the roll paper 21 is thereafter sensed by a registration sensor 23. Then, the leading end of the roll paper comes into abutting contact with a nip portion between a registration roller 31 driven by a registration roller motor 45 and a registration upper roller 32 rotating in conjunction with the registration roller 31. The roller pair corrects possible skewing, while conveying the roll paper 21 to a printing portion in which an ink jet print head 7 is located.

The figures show that the print medium between the roll paper rotating member 22 and the registration roller 31 is under tension. However, in actuality, the print medium is controlled such that a given loop is formed between the roll paper rotating member 22 and the registration roller 31, based on the results of detection by a loop sensor (not shown in the drawings). Thus, the registration roller 31 is subjected to a given back tension, preventing a possible decrease in conveyance accuracy.

Figure 2:
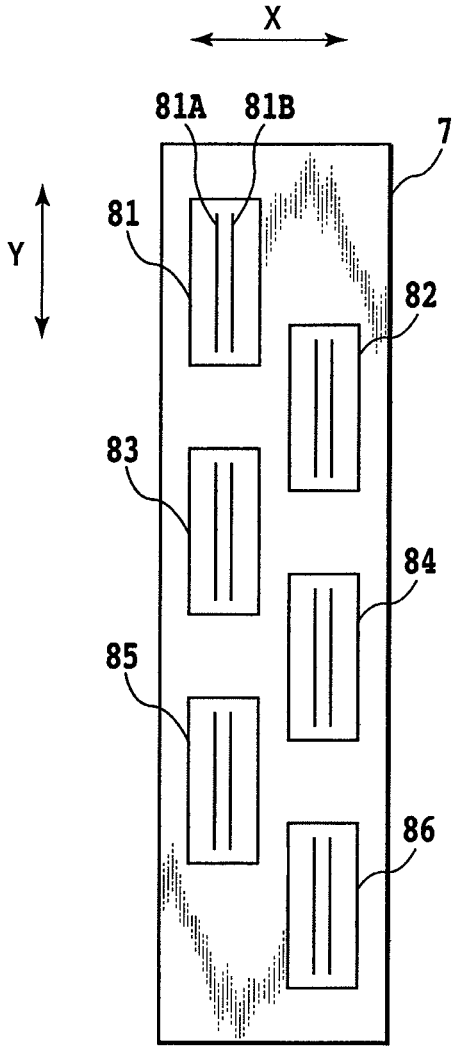
FIG.2 PRIOR ART
FIG. 2 is a diagram showing arrays of ejection ports in an elongate ink jet print head disclosed in Japanese Patent Laid-Open No. 2005-199696.
Figure 3:
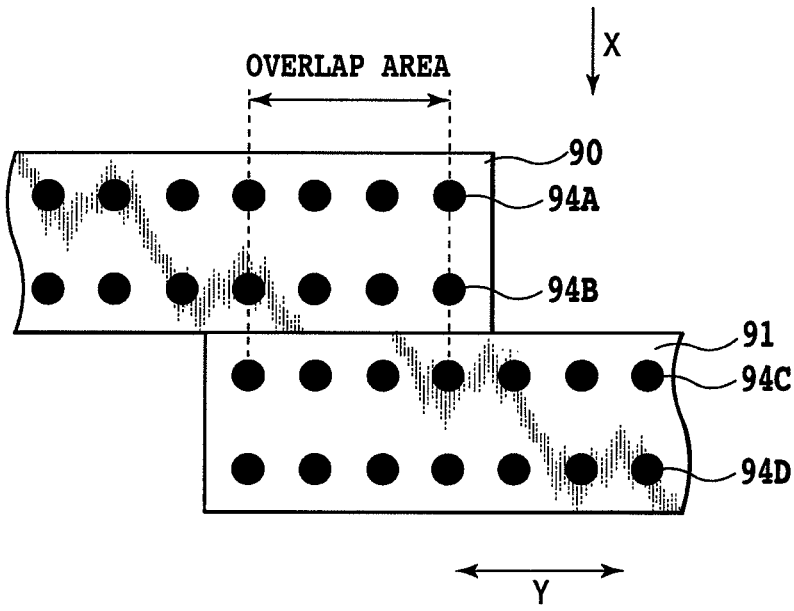
FIG.3 PRIOR ART
FIG. 3 is a diagram showing arrays of ejection ports in two chips 90 and 91 in a checker type print head disclosed in Japanese Patent Laid-Open No. 2005-199696.

The printing portion is located on the downstream side of the registration roller 31. Four ink jet print heads 7 are arranged opposite the surface of the print medium. Each of the ink jet print heads 7 has a first chip with a plurality of ejection ports arranged at predetermined intervals in a second direction crossing a first direction (the second direction is, for example, orthogonal to the first direction); ink is ejected from the ejection ports onto the print medium moving relative to the ink jet print heads 7 in the first direction, to print dots. The ink jet print head 7 also has a second chip located on the downstream side of the first chip in the first direction. Thus, dots can be printed on the print medium at predetermined intervals in the second direction. Here, the first direction corresponds to an X direction in the figures. The second direction corresponds to a Y direction in the figures. Each of the ink jet print heads is a checker type print head configured as already described with reference to FIG. 2. In the present embodiment, four ink jet print heads ($7n-1$), ($7n$), ($7n+1$), and ($7n+2$) that eject respective types of color ink are prepared to enable a full-color image to be formed on the print medium. However, the number of ink jet print heads, the types of ink, and the number of ejection port arrays arranged in each of the chips do not limit the present invention and may be varied depending on the intended use.

A pair of a spur 42 and a spur driving roller 41 is located on each of the opposite sides of each of the ink jet print heads (between the adjacent ink jet print heads) to prevent a print area for the ink jet print head from floating. Each of the spur driving rollers 41 is driven by a driving roller motor 44 via a spur driving roller clutch 43. A platen 29 supporting the print medium from below is located on the area of the print medium printed by each of the print heads 7. Some ribs are provided on the side of the platen 29 which contacts the roll paper. This prevents the print medium from being displaced downward.

A conveying roller 33 and a conveying upper roller 34 are arranged further downstream of the printing portion; the conveying roller 33 is driven by the driving roller motor 44, and the conveying upper roller 34 rotates in conjunction with rotation of the conveying roller 33. The printed roll paper 21 is nipped by the roller pair and guided to a sheet discharging guide 36. The roll paper 21 is thereafter subjected to a post-process with a cutter or the like.

In the present embodiment, the operation of the driving roller motor 44, registration roller motor 45, and print head driver 47 is controlled by an operation control portion 46. The operation control portion 46 estimates the conveyance amount and speed of the print medium based on the rotation amount of the registration roller 31, contained in information from an encoder sensor provided at the registration roller 31. The operation control portion 46 uses the information to control the registration roller 31, the conveying roller 33, and the spur driving roller 41 to adjust the conveying speed of the print medium. A head driver 47 is thus driven based on image data at timings appropriate to the conveying speed to eject ink from the ink jet print heads 7. Thus, an image is printed on the print medium moving relative to the ink jet print heads 7.

In general, in the full-line type printing apparatus, the initial amount of meandering (skew) of the roll paper is determined by the balance between the direction in which the conveying roller pulls the print medium and the means (regulating plate) for regulating the movement direction of the print medium. In the printing apparatus mechanically configured as described above, the roll paper 21 may be displaced in the Y direction during conveyance by the axial runout of the conveying roller 33 and the registration roller 31 or by a driving transmission system between the rollers and the corresponding motors. However, the force of the loop of the roll paper as described above is applied to the regulating plate 24, which regulates the conveyance direction of the roll paper. Once the force reaches a certain limit, the relevant stress reverses the displacement direction of the print medium. The displacement in the Y direction is varied by the peripheral length of the conveying roller 33 and the large cycle of the driving transmission system. The displacement has a large amplitude. However, the continued conveyance tends to gradually stabilize the displacement.

Figure 7A:
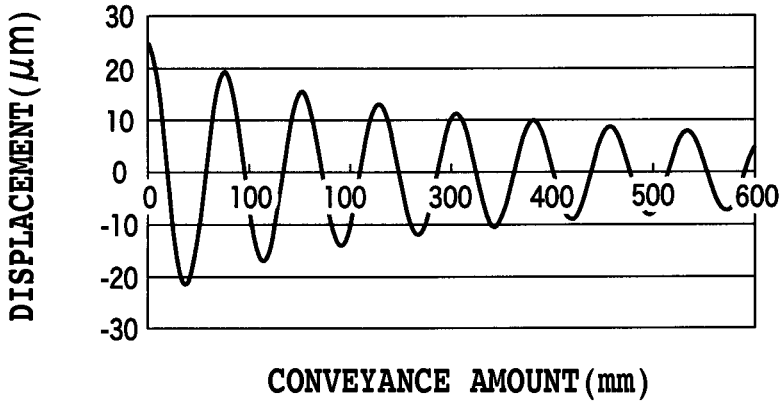
FIG. 7A is a diagram illustrating the relationship between the amount of roll paper conveyed and a measured displacement in the printing apparatus according to the present embodiment.

FIG. 7A is a diagram illustrating the relationship between the conveyance amount of roll paper and the measured displacement in the printing apparatus according to the present embodiment. In FIG. 7A, the axis of abscissa shows the conveyance amount continuously measured from a point in time when feeding of the roll paper is started. The axis of ordinate shows the displacement of the print medium in the Y direction measured at the timings of the respective conveyance amounts. The figure shows that the continued conveyance reduces the amplitude of the displacement. That is, the above-described black or white stripes are expected to become unnoticeable as the conveyance continues.

Figure 6A:
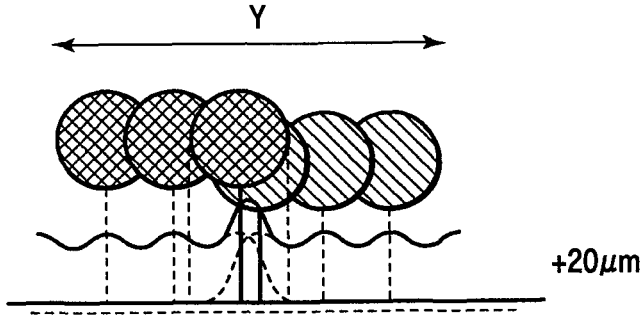
FIG.6A PRIOR ART
FIGS. 6A to 6E are diagrams showing dot print conditions and dot density distributions observed when an ink jet print head 100 is used, each of the diagrams showing the case in which a print medium is conveyed in a regular direction shown by an alternate long and short dash line in FIG. 4 and the case in which the print medium is skewed during the conveyance as shown by a solid arrow in FIG. 4.
Figure 6B:
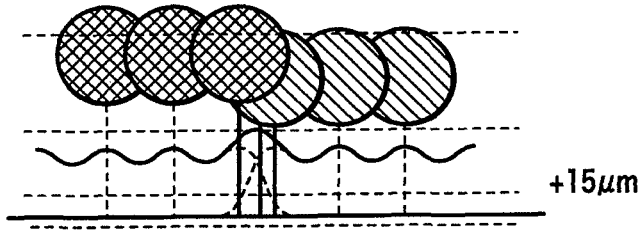
FIG.6B PRIOR ART
Figure 6C:
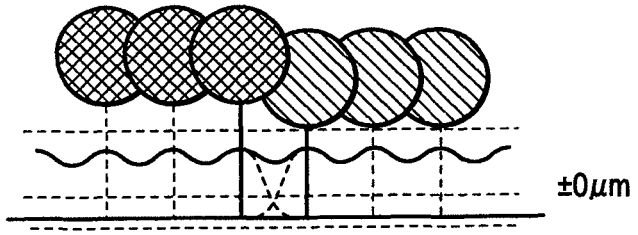
FIG.6C PRIOR ART
Figure 6D:
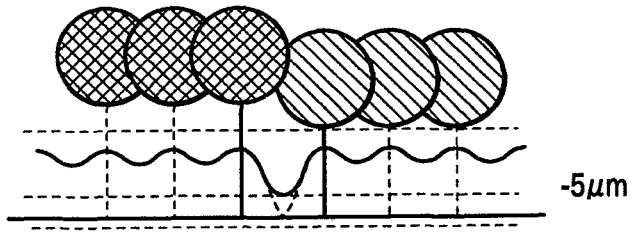
FIG.6D PRIOR ART
Figure 6E:
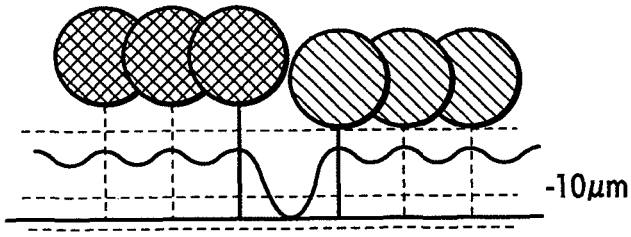
FIG.6E PRIOR ART

The results of the present inventors' keen examinations indicate that even with an equivalent amount of misalignment, the noticeability of white stripes, that is, the adverse effect of white stripes on image quality, differs from that of black stripes. Specifically, when an image was printed with dots of diameter about 35 μm at a print resolution of 1,200 dpi, white stripes were observed to the level shown in FIG. 6E, that is, with a misalignment amount of about −10 μm. However, black stripes were not observed with a misalignment amount of +10 μm but observed with a misalignment amount of about +20 μm, corresponding to nearly one pixel, as shown in FIG. 6A. That is, the white stripes were determined to offer a narrower allowable range for the skew of the print medium than the black stripes.

Figure 4:
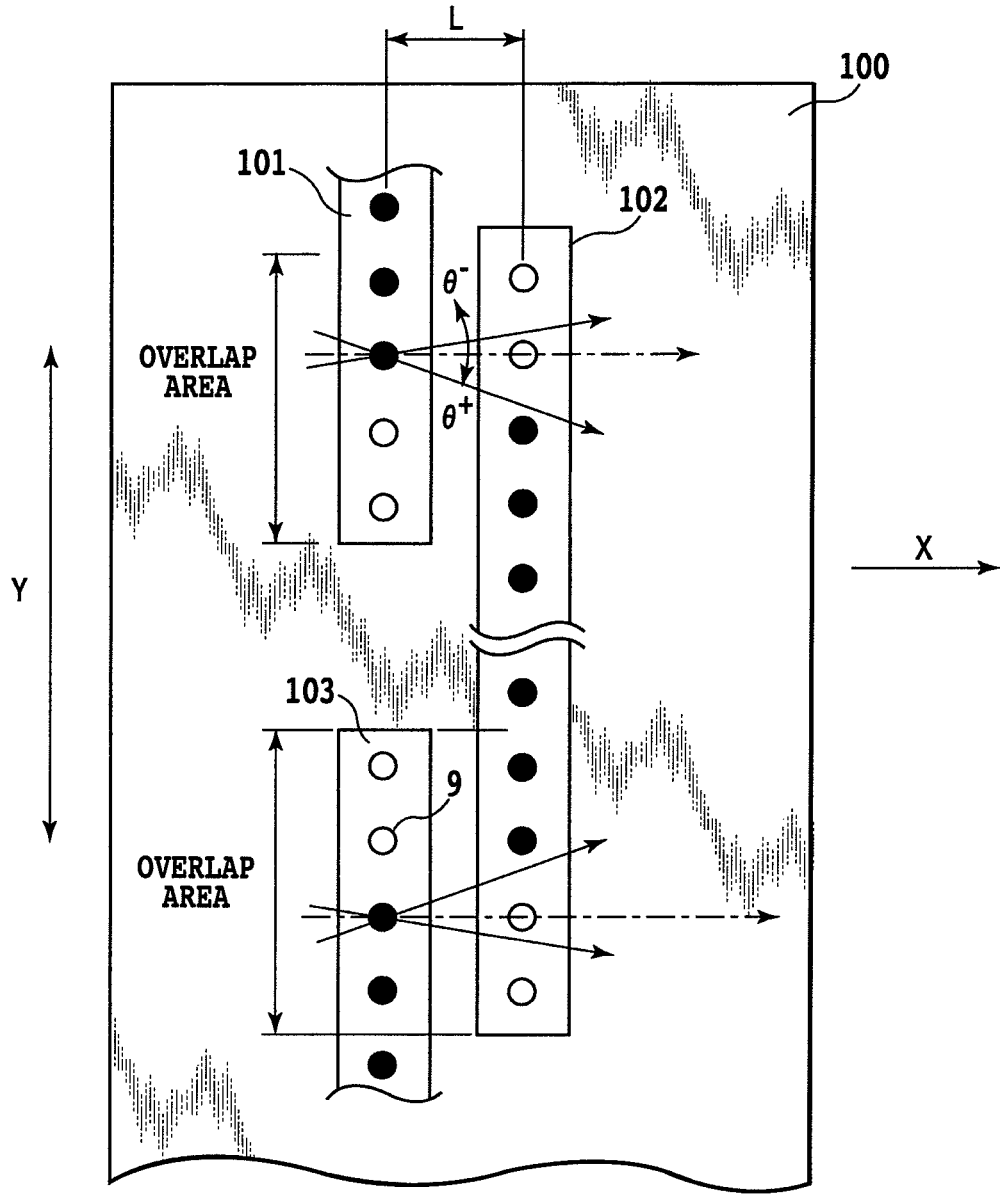
FIG.4 PRIOR ART
FIG. 4 is a schematic diagram of a print head illustrating the negative effects of meandering of a print medium.
Figure 5A:
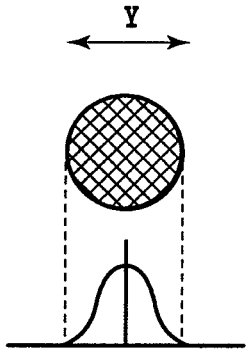
FIG.5A PRIOR ART
FIGS. 5A and 5B are diagrams showing print conditions and dot density distributions observed when the checker array print head shown in FIG. 4 is used, wherein in FIG. 5A, one dot of diameter 35 μm is printed, and in FIG. 5B, three dots are consecutively printed in a Y direction at a print resolution of 1,200 dpi.
Figure 5B:
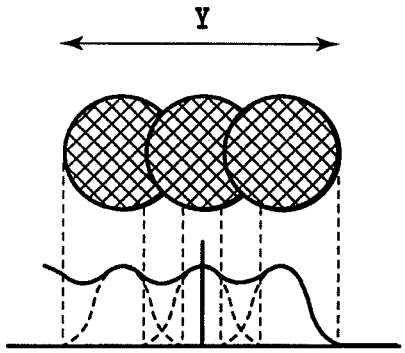
FIG.5B PRIOR ART

For example, for simplification, the print head 7 used in the present embodiment is configured as shown in FIG. 4. In the configuration shown FIG. 4, each of the chips includes one ejection port array composed of a plurality of ejection ports arrayed at a pitch of 1,200 dpi in the Y direction (second direction). The first chip 101, positioned on the upstream side in the conveyance direction, and the second chip 102, positioned on the downstream side in the conveyance direction, are arranged such that there is a distance L of 20 μm between two ejection ports corresponding to each other in the first and second chips 101 and 102 in the X direction (first direction). In this case, when the amount of misalignment between the dots printed via the first chip 101 and the dots printed via the second chip 102 is at most −10 μm, white strips occur. When the amount of misalignment between the dots printed via the first chip 101 and the dots printed via the second chip 102 is at least +20 μm, black strips occur.

Figure 7B:
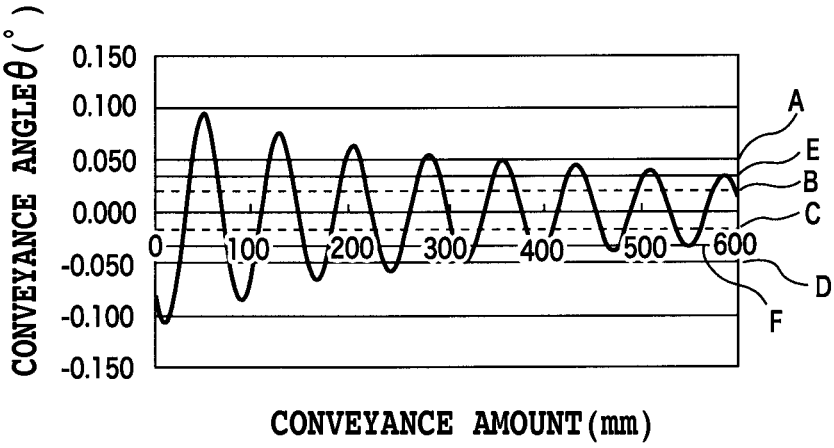
FIG. 7B is a diagram obtained by converting the displacement of the print medium on the axis of ordinate in FIG. 7A into the conveyance angle at which the print medium is conveyed.

FIG. 7B is a diagram obtained by converting the displacement of the print medium on the axis of ordinate in FIG. 7A into the conveyance angle (θ) at which the print medium is conveyed. In this case, for the first and second chips 101 and 102, when the conveyance angle is equal to or smaller than the value indicated by a C line, the amount of misalignment between the two groups of dots is at most −10 μm. Thus, white strips occur. On the other hand, when the conveyance angle is equal to or larger than the value indicated by an A line, the amount of misalignment between the two groups of dots is at least +20 μm. Thus, black strips occur. That is, for the first and second chips 101 and 102, the region between the A line and the C line corresponds to the allowable range within which no white or black stripes occur.

For the chips 102 and 103, when the conveyance angle is equal to or smaller than the value indicated by a D line, black strips occur. When the conveyance angle is equal to or larger than the value indicated by a B line, white strips occur. For the chips 102 and 103, the region between the B line and the D line corresponds to the allowable range within which no white or black stripes occur. As a result, with all the chips including the chips 101 to 103 considered, only the conveyance angle (θ) within the range between the B line and the C line is allowable in connection with image formation.

However, for actual printing apparatuses, it is difficult to improve conveyance accuracy so that the conveyance direction of the print medium falls within the above-described range. Thus, in particular, in images initially printed after the start of the printing, white or black stripes appear inevitably.

In connection with this, the present inventors have noted that the center (θ=0°) of the amplitude of the actual conveyance angle deviates from the center (for example, the center of the region between the A line and the C line) of the allowable range. The present inventors have determined that the arrangement of the first and second chips 101 and 102 can be effectively changed such that the center of the amplitude of the amount of misalignment between the dots actually printed via the first chip 101 and the dots actually printed via the second chip 102 is positioned at the center of the allowable range, that is, at the average value of the A and C lines. Specifically, even in the regular conveyance direction, in which no meandering occurs, the first and second chips 101 and 102 are staggered in a direction in which slight black stripes occur.

Figure 8:
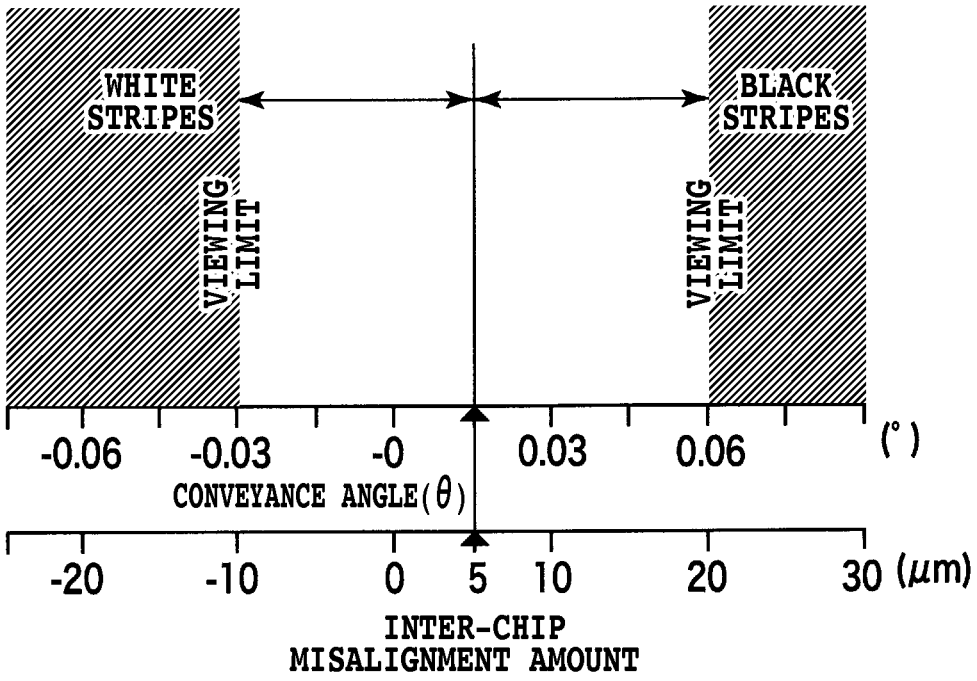
FIG. 8 is a diagram illustrating the amount of misalignment between chips 101 and 102 with respect to an allowable area.

FIG. 8 is a diagram illustrating the amount of staggering between the first and second chips 101 and 102 with respect to the allowable range. The allowable range according to the present embodiment corresponds to the range, from −10 μm to +20 μm, of the amount of misalignment between the dots printed via the first chip 101 and the dots printed via the second chip 102. The average value of the misalignment amount is +5 μm. Thus, in the print head according to the present embodiment, the first and second chips 101 and 102 are staggered by +5 μm.

Figure 9:
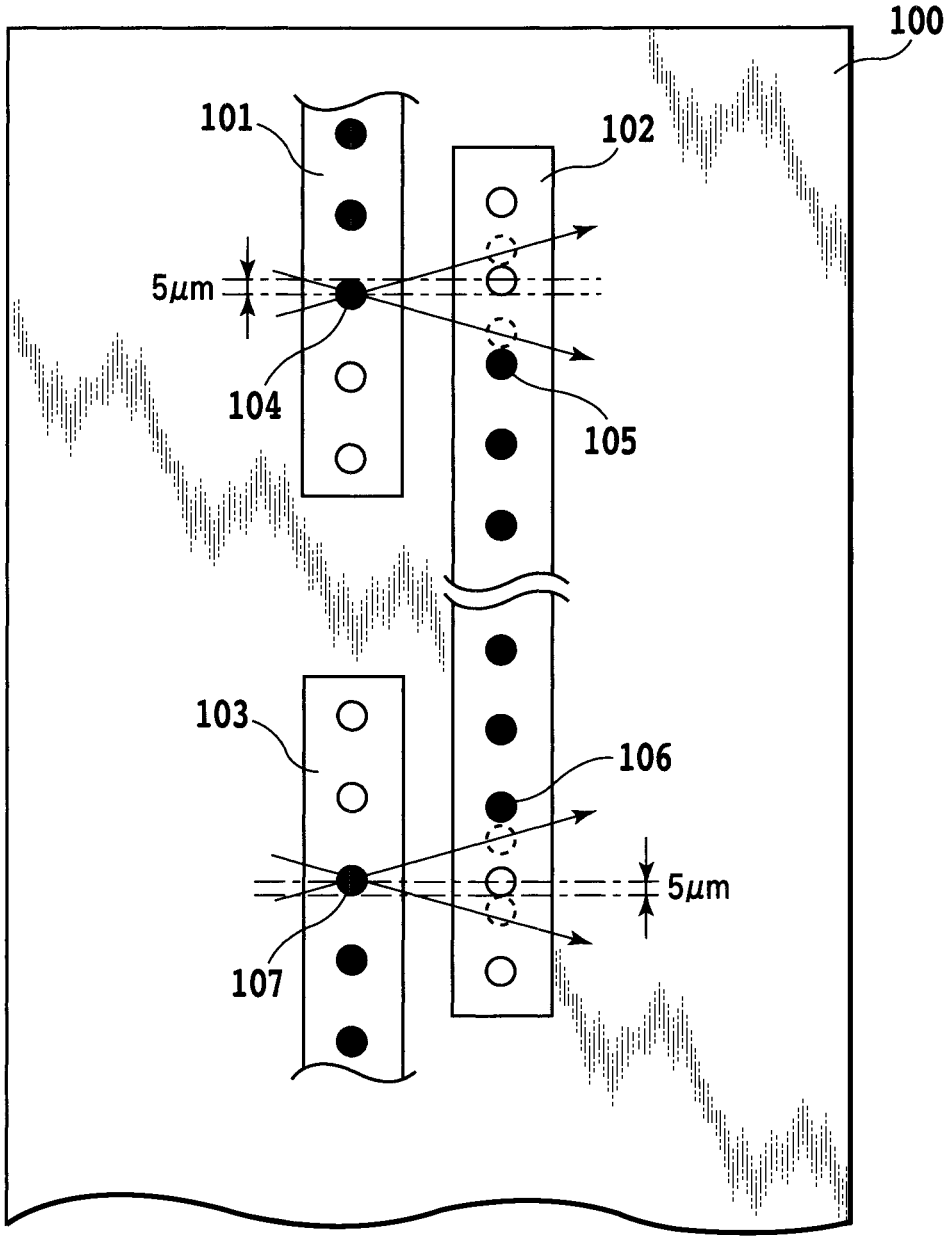
FIG. 9 is a diagram illustrating how chips are arranged in the print head according to the embodiment of the present invention, compared to FIG. 4.

FIG. 9 is a diagram illustrating how chips are arranged in the print head according to the embodiment, compared to FIG. 4. The first and second chips 101 and 102 are arranged in the direction in which the overlap area between the chips 101 and 102 widens (the direction for black stripes). Specifically, the chips 101 and 102 are arranged such that the ejection port 104 in the first chip 101 and the ejection port 105 in the second chip 102 are positioned at intervals shorter than predetermined ones (21 μm) by 5 μm in the Y direction; the pixel printed via the ejection port 104 is adjacent to the pixel printed via the ejection port 105. The chips 102 and 103 are also arranged in the direction in which the overlap area between the chips 102 and 103 widens. That is, the chips 102 and 103 are arranged such that ejection port 106 in the chip 102 and ejection port 107 in the second chip 103 are positioned at intervals shorter than predetermined ones (21 μm) by 5 μm in the Y direction; the pixel printed via the ejection port 106 is adjacent to the pixel printed via the ejection port 107. In the print head according to the present embodiment, the chips are arranged so as to satisfy the above-described relationship among all the chips on the print head.

When the chips are arranged in the print head as described above, as shown in FIG. 7B, for the first and second chips 101 and 102, white stripes occur when the conveyance angle is equal to or smaller than the value indicated by an F line. Black stripes occur when the conveyance angle is equal to or larger than the value indicated by an E line. That is, for the first and second chips 101 and 102, the allowable range corresponds to the region between the E line and the F line. For the chips 102 and 103, when the conveyance angle is equal to or smaller than the value indicated by the F line, black stripes occur. When the conveyance angle is equal to or larger than the value indicated by the E line, white stripes occur. That is, also for the chips 102 and 103, the allowable range corresponds to the region between the E line and the F line. As a result, with all the chips including the chips 101 to 103 considered, the conveyance angle within the range between the E line and the F line is allowable in connection with image formation. The present embodiment thus enables a significant increase in the allowable range of the conveyance angle compared to the conventional art, in which the allowable range corresponds to the region between the B line and the C line.

That is, the present embodiment does not require such an accurate print medium conveyance angle (θ) as in the conventional art. The present embodiment further enables even initial images to be output properly with white or black stripes prevented from appearing relatively early.

Other Embodiments

The configuration of the print head mounted in the printing apparatus has been described for which a change in conveyance angle is predictable as shown in FIGS. 7A and 7B. However, the range or direction of variation in the actual conveyance angle may vary among printing apparatuses owing to a possible variation during the manufacture of the apparatuses. To deal with this case, the arrangement of a plurality of chips in each print head is adjusted during the manufacturing process so as to correspond to the conveyance accuracy of the printing apparatus. Specifically, first, for each printing apparatus, for example, such information on the range of variation in the conveyance of a print medium as shown in FIGS. 7A and 7B is acquired. Then, based on the variation range acquired, the distance, in the Y direction, between each of the ejection ports in the first chip 101 and the adjacent ejection port in the second chip 102 is set to a value smaller than that of the pitch of the normal ejection ports. Thereafter, the first and second chips are arranged so as to achieve the set distance.

In this case, for example, if the range of variation in actual conveyance angle, that is, the amplitude of the displacement, is large, the amount of staggering can be increased. If the amplitude of the displacement is small, the amount of staggering can be reduced. Furthermore, for a printing apparatus with the conveyance angle tending to be limited to either the + or − direction, the amount of staggering for the first and second chips may differ from that for the second and third chips in order to suppress the white stripe.

In the above-described embodiment, the characteristic configuration of the present invention inhibits the negative effects on images associated with possible black or white stripes, which cannot be eliminated by Japanese Patent Laid-Open No. 2005-199692. However, the present invention can be implemented in connection with such a conventional technique as described in Japanese Patent Laid-Open No. 2005-199692. That is, with individual chips staggered in the direction in which the overlap area between the chips increases, a plurality of ejection ports in the different chips may be used to print an image as disclosed in Japanese Patent Laid-Open No. 2005-199692.

Furthermore, in the above-described embodiment, when dots of diameter 35 μm are used to print an image at a print resolution of 1,200 dpi, the overlap area between the individual chips is increased by about 5 μm. However, of course, these numerical values are not intended to limit the present invention. The dot size or the noticeability of black or white stripes varies depending on the type of the print medium or ink. Any numerical values may fall within the scope of the present invention provided that in each situation, the allowable range within which white or black stripes are unnoticeable is determined and that the arrangement of the chips is adjusted such that the allowable range is as equal among the combinations of the individual chips as possible.

Moreover, the full-line type printing apparatus has been described by way of example. The present invention is not limited to this type of printing apparatus. The present invention functions effectively provided that a checker array print head composed of a plurality of chips is used in the printing apparatus regardless of the type of the printing apparatus in which the present invention is implemented. With the full-line type printing apparatus, low-frequency and large-amplitude image degradation is noticeable which has a period corresponding to the peripheral length of a driving roller continuously conveying a print medium. Thus, the present invention is particularly effective on this type of printing apparatus. However, the present invention can be suitably adopted for a serial type of printing apparatus which prints an image by alternately switching a main scan in which the ink jet print head scans the print medium and the operation of conveying the print medium. With the serial type, a possible skew in a main scanning direction may be varied by, for example, the weight of the ink jet print head imposed on a guide shaft supporting the main scan (movement relative to the print medium) by the ink jet print head. Thus, black or white stripes may occur as is the case with the above-described embodiment. Even in this case, the black or white stripes can be made unnoticeable by adjusting the arrangement of the individual chips in the checker array print head as described above in the embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-161757, filed Jun. 20, 2008 which is hereby incorporated by reference herein in its entirety.

What is claimed is:

1. A method of manufacturing an ink jet print head comprising a first chip and a second chip provided on a supporting member, each chip including a plurality of ejection ports from which ink is ejected onto a print medium moving in a first direction, the ejection ports being arrayed at a predetermined interval in a second direction crossing the first direction, the first and second chips being arranged on a upstream side and on a downstream side, respectively, relative to the first direction so that the plurality of ejection ports in the first and second chips are consecutively arrayed in the second direction, the method comprising:

a step of acquiring an amount of skew in the second direction with respect to the first direction of the print medium during moving in the first direction;

a setting step of setting a distance between an ejection port in the first chip and an ejection port in the second chip based on the amount of skew, the ejection ports in the first and second chips being used to print pixels adjacent to each other in the second direction; and an arranging step of arranging the first and second chips on the supporting member according to the distance, wherein in the setting step, based on the amount of skew, the distance is set to be smaller than the predetermined interval.

2. The method of manufacturing the print head according to claim 1, wherein in the setting step, the distance is reduced with an increase in the amount of skew.

3. The method of manufacturing the print head according to claim 1, wherein in the arranging step, according to the distance, a plurality of the first chips and a plurality of the second chips are alternately arranged on the upstream side and downstream side, respectively, in the first direction so that they are consecutively arrayed in the second direction.

* * * * *